US010852664B1

(12) United States Patent
Tohata

(10) Patent No.: US 10,852,664 B1
(45) Date of Patent: Dec. 1, 2020

(54) IMAGE FORMING APPARATUS AND TONER CARTRIDGE

(71) Applicant: TOSHIBA TEC KABUSHIKI KAISHA, Tokyo (JP)

(72) Inventor: Nobuo Tohata, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/791,908

(22) Filed: Feb. 14, 2020

(51) Int. Cl.
*G03G 15/08* (2006.01)

(52) U.S. Cl.
CPC ..... *G03G 15/0856* (2013.01)

(58) Field of Classification Search
CPC ..... G03G 15/0856; G03G 15/0877; G03G 15/0849
See application file for complete search history.

(56) References Cited

U.S. PATENT DOCUMENTS 8,626,017 B2 1/2014 Sakatani et al.
9,709,919 B2 7/2017 Saitoh et al.
2007/0058996 A1* 3/2007 Sakita ..... G03G 15/553 399/27
2011/0318024 A1* 12/2011 Kawaguchi ..... G03G 15/0863 399/27
2015/0331355 A1* 11/2015 Wada ..... G03G 15/556 399/30
2016/0378020 A1* 12/2016 Asaka ..... G03G 15/0863 399/27

OTHER PUBLICATIONS

U.S. Appl. No. 16/565,551, filed Sep. 10, 2019, Moriya.

* cited by examiner

*Primary Examiner* — Sandra Brase
(74) *Attorney, Agent, or Firm* — Foley & Lardner LLP

(57) ABSTRACT

An image forming apparatus includes a supply unit and a control unit. The supply unit supplies a recording agent to a storage unit from a recording agent cartridge. The control unit is configured to at least one of (i) estimate a discharged amount of the recording agent discharged from the recording agent cartridge to form an image based on (a) a running amount of the supply unit used to form the image and (b) an additive characteristic of the additive added to the recording agent or (ii) estimate a supply amount to be discharged from the recording agent cartridge by the supply unit to form the image based on (a) the running amount of the supply unit necessary to form the image and (b) the additive characteristic of the additive added to the recording agent, and cause the supply unit to run based on the supply amount.

20 Claims, 10 Drawing Sheets

| | |
|---|---|
| A1 | IDENTIFICATION CODE |
| A2 | THRESHOLD INFORMATION |
| A3 | CORRECTION COEFFICIENT |
| A4 | INTEGRATED COUNTER |

| | |
|---|---|
| B1 | IDENTIFICATION CODE |
| B2 | THRESHOLD INFORMATION |
| B3 | CORRECTION COEFFICIENT |
| B4 | INTEGRATED COUNTER |

| EXTERNAL ADDITIVE COVERAGE FACTOR | CORRECTION COEFFICIENT |
|---|---|
| 131%~135% | 0.95 |
| 111%~130% | 1.00 |
| 105%~110% | 1.05 |

| EXTERNAL ADDITIVE COVERAGE FACTOR | CORRECTION COEFFICIENT |
|---|---|
| 131%~135% | 1.05 |
| 111%~130% | 1.00 |
| 105%~110% | 0.95 |

| WHETHER OR NOT CORRECTION IS PERFORMED | EXTERNAL ADDITIVE COVERAGE FACTOR | CORRECTION COEFFICIENT | ACTUALLY REMAINING AMOUNT OF TONER WHEN DISPLAYED REMAINING AMOUNT IS 15% |
|---|---|---|---|
| CORRECTION | 120% | 1.00 | 15% |
| | 133% | 1.05 | 15% |
| | 108% | 0.95 | 15% |
| NO CORRECTION | 133% | — | 23% |
| | 108% | — | 8% |

FIG. 12

| EXTERNAL ADDITIVE ADHESION INTENSITY | CORRECTION COEFFICIENT |
|---|---|
| 91%～95% | 0.93 |
| 76%～90% | 1.00 |
| 71%～75% | 1.07 |

FIG. 13

| EXTERNAL ADDITIVE ADHESION INTENSITY | CORRECTION COEFFICIENT |
|---|---|
| 91%～95% | 1.07 |
| 76%～90% | 1.00 |
| 71%～75% | 0.93 |

FIG. 14

| WHETHER OR NOT CORRECTION IS PERFORMED | EXTERNAL ADDITIVE ADHESION INTENSITY | CORRECTION COEFFICIENT | ACTUALLY REMAINING AMOUNT OF TONER WHEN DISPLAYED REMAINING AMOUNT IS 15% |
|---|---|---|---|
| CORRECTION | 85% | 1.00 | 15% |
| | 93% | 1.07 | 15% |
| | 72% | 0.93 | 15% |
| NO CORRECTION | 93% | — | 23% |
| | 72% | — | 8% |

IMAGE FORMING APPARATUS AND TONER CARTRIDGE

FIELD

Embodiments described herein relate generally to an image forming apparatus and a toner cartridge.

BACKGROUND

An image forming apparatus may supply toner from a mounted toner cartridge. The image forming apparatus may detect a remaining amount of toner in the mounted toner cartridge. The image forming apparatus may perform a method to detect a remaining amount of toner in the toner cartridge based on the number of rotations or a driving time of a motor for supplying the toner. In this method, toner is considered to be supplied in proportion to the number of rotations of the motor or the like and the remaining amount of the toner is detected.

However, due to characteristics of an external additive added to toner, a variation in bulk density of the toner for each toner cartridge may occur in some cases. Thus, there can be an error in the estimation of the remaining amount of toner by assuming that the toner is supplied simply in proportion to the number of rotations of the motor or the like.

DESCRIPTION OF THE DRAWINGS

FIG. 12 is a diagram illustrating an example of a relationship between the external additive adhesion intensity and a correction coefficient;

FIG. 13 is a diagram illustrating another example of the relationship between the external additive adhesion intensity and the correction coefficient;

FIG. 14 is a diagram illustrating a measurement result in a correction performed using a supply counter correction coefficient based on the external additive adhesion intensity;

DETAILED DESCRIPTION

An exemplary embodiment provides an image forming apparatus and a toner cartridge capable of improving detection precision of a remaining amount of toner.

In general, according to an embodiment, an image forming apparatus includes a supply unit and a control unit. The supply unit supplies a recording agent to a storage unit from a recording agent cartridge. The control unit derives remaining amount information regarding a remaining amount of the recording agent in the recording agent cartridge based on a physical amount proportional to a running amount of the supply unit and external additive characteristic information determined in accordance with characteristics of an external additive added to the recording agent.

According to an embodiment, an image forming apparatus includes a supply unit and a control unit. The supply unit supplies a recording agent to a storage unit from a recording agent cartridge. The control unit corrects a physical amount proportional to a running amount of the supply unit based on external additive characteristic information determined in accordance with characteristics of an external additive added to the recording agent and causes the supply unit to run based on the corrected physical amount.

Hereinafter, an image forming apparatus and a toner cartridge according to an embodiment will be described with reference to the drawings.

Figure 1:
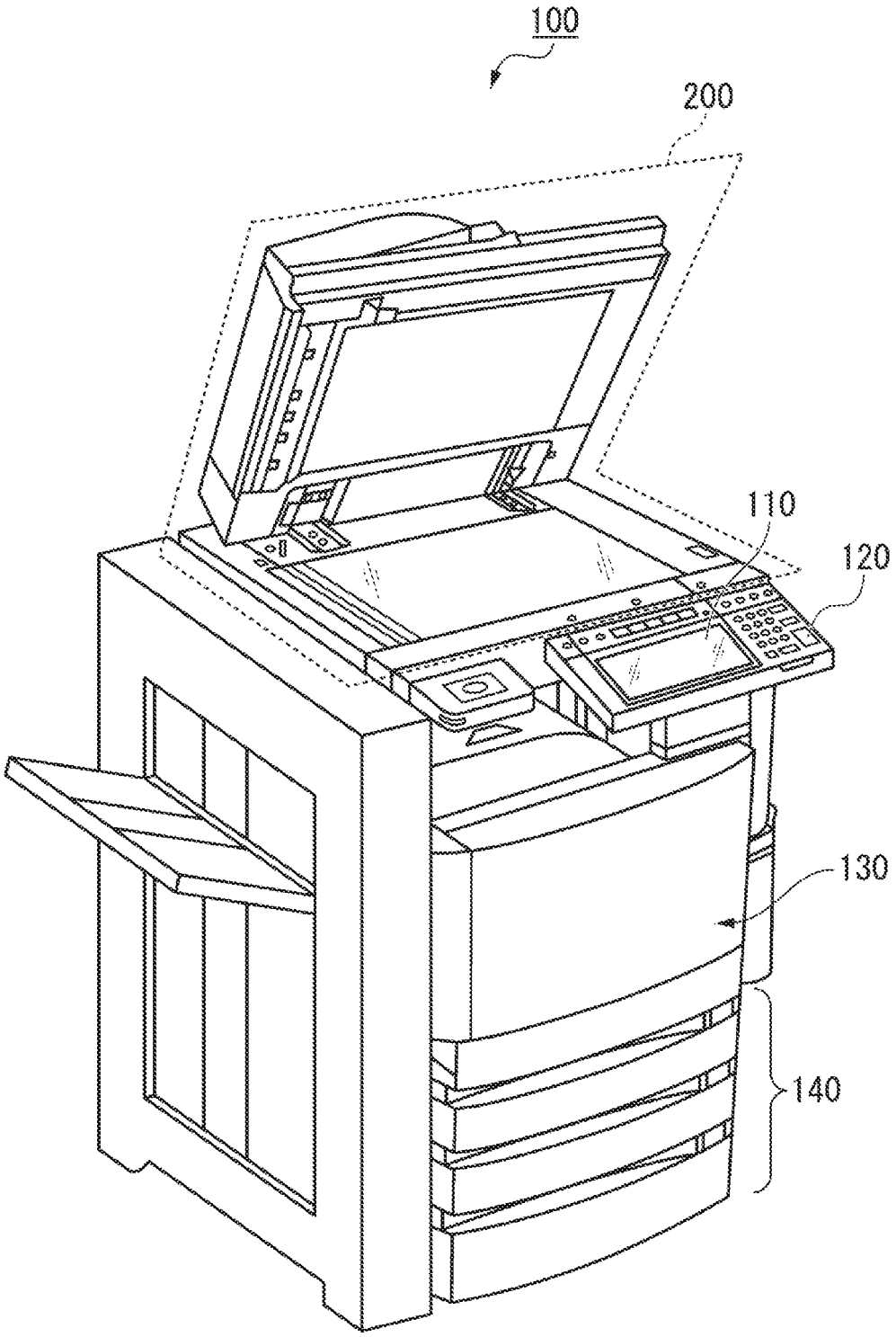
FIG. 1 is an external view illustrating an overall configuration example of an image forming apparatus according to an embodiment.
Figure 2:
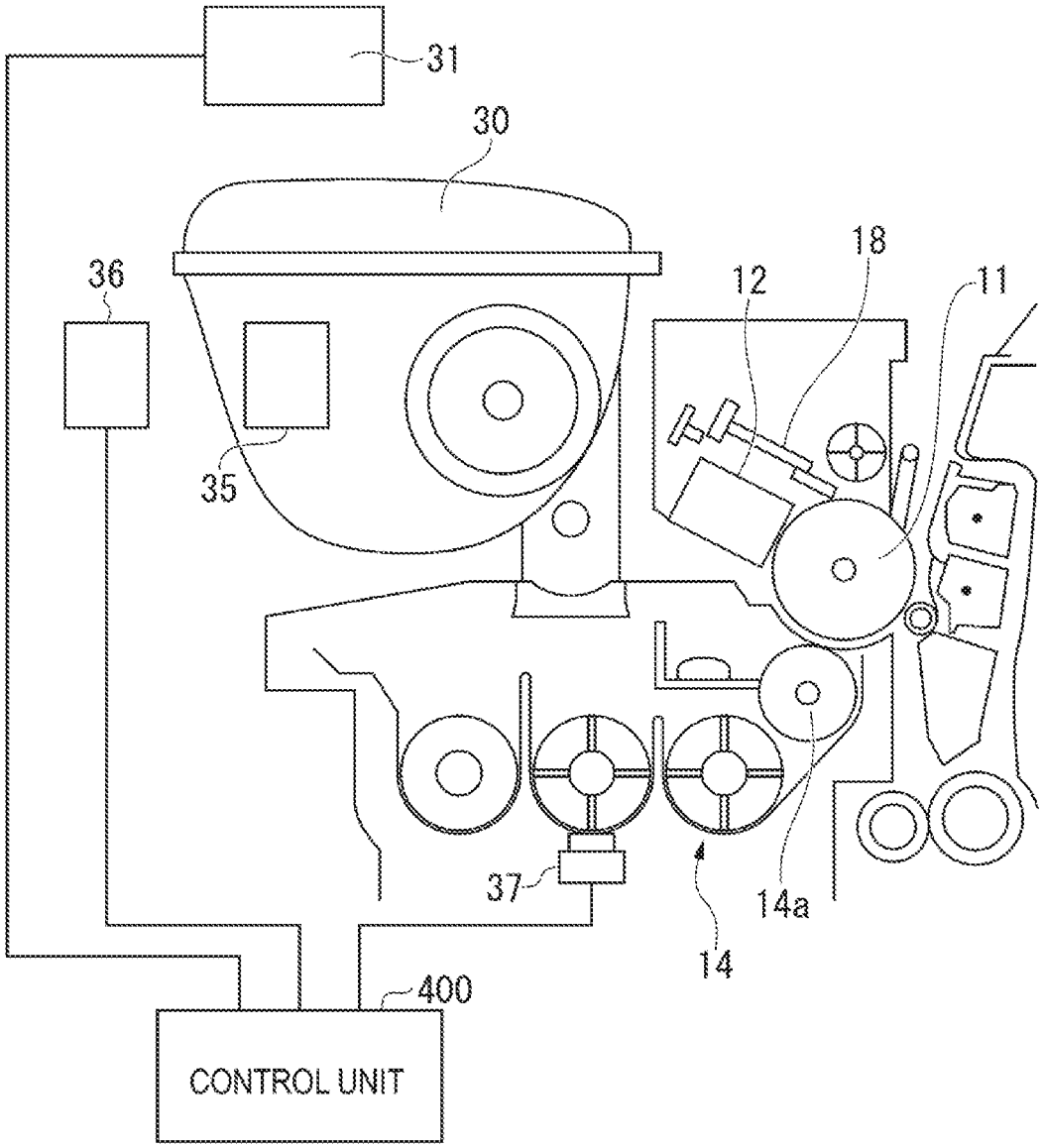
FIG. 2 is a block diagram illustrating a configuration related to detection of a remaining amount of toner.

FIG. 1 is an external view illustrating an overall configuration example of an image forming apparatus 100 according to an embodiment. The image forming apparatus 100 is, for example, a multi-function peripheral. The image forming apparatus 100 includes a display 110, a control panel 120, a print unit 130, a sheet accommodation unit 140, and a scan unit 200. The image forming apparatus 100 includes a control unit 400 that controls the entire apparatus, as illustrated in FIG. 2.

The image forming apparatus 100 forms an image on a sheet using developer. The developer is, for example, toner. In the following description, developer will be described as toner. The developer is an example of a recording agent. The sheet is, for example, a paper or a label sheet. The sheet may be any object as long as the image forming apparatus 100 can form an image on the surface thereof.

The display 110 is an image display device such as a liquid crystal display or an organic electroluminescence (EL) display. The display 110 displays various kinds of information regarding the image forming apparatus 100.

The control panel 120 includes a plurality of buttons. The control panel 120 receives an operation by a user. The control panel 120 outputs a signal in response to an operation performed by the user to the control unit 400 of the image forming apparatus 100. The display 110 and the control panel 120 may be configured as an integrated touch panel.

The print unit 130 prints an image on a sheet based on image information generated by the scan unit 200 and/or image information received via a network. The print unit 130 prints the image using toner. A sheet on which the image is printed may be a sheet accommodated in the sheet accommodation unit 140 or may be a sheet which is manually set.

The sheet accommodation unit 140 accommodates one or more sheets to be used for image formation in the print unit 130.

The scan unit 200 reads image information to be read based on brightness and darkness of light. The scan unit 200 records the read image information. The recorded image information may be transmitted to another information processing apparatus via a network. The recorded image information may be formed as an image on a sheet by the print unit 130.

FIG. 2 is a block diagram illustrating a configuration related to detection of a remaining amount of toner of the image forming apparatus 100. FIG. 2 illustrates the control unit 400, a toner cartridge 30, a toner supply motor 31, a storage unit or a storage medium 35, a reading and writing unit 36, and a detection sensor 37. FIG. 2 illustrates a photosensitive drum 11, an electrostatic charger 12, a development device 14, a development drum 14*a*, and a cleaner 18.

The photosensitive drum 11 includes an organic photo conductor (OPC) on a support member surface. The electrostatic charger 12 uniformly charges the photosensitive drum 11 sequentially in accordance with rotation of the photosensitive drum 11. The cleaner 18 removes any toner remaining on the photosensitive drum 11. In the development device 14, an electrostatic latent image formed on the photosensitive drum 11 is developed with toner by the development drum 14*a*.

As illustrated in an upper portion of FIG. 2, the toner cartridge 30 is provided in an upper portion of the development device 14. A supply mechanism (supply auger) in the toner cartridge 30 is driven with rotation of the toner supply motor 31 so that the toner is supplied to the development device 14. The toner cartridge 30 is an example of a recording agent cartridge. The toner supply motor 31 is an example of a supply unit. The development device 14 is an example of a storage unit.

In the development device 14, the detection sensor 37 measuring magnetic permeability of developer is provided. The detection sensor 37 acquires a toner amount indicating an amount of toner stored in the development device 14. As the toner amount, a mass ratio (T/C) of the toner to carriers is used. It can be detected that the toner is insufficient in accordance with a measurement value of the detection sensor 37.

The toner cartridge 30 includes the storage medium 35 (e.g., coupled to the housing, body, casing, etc. thereof). The storage medium 35 stores toner characteristic information regarding the toner cartridge 30. The toner characteristic information includes external additive characteristic information regarding characteristics of an external additive added to the toner with which the toner cartridge 30 is filled (e.g., in a reservoir, chamber, cavity, etc. defined by a body, housing, casing, etc. of the toner cartridge 30).

The reading and writing unit 36 reads information from the storage medium 35 and writes information on the storage medium 35. Some toner characteristic information is stored in the storage medium 35 and some toner characteristic information is stored in the main body of the image forming apparatus 100. To distinguish these pieces of toner characteristic information from each other, the toner characteristic information stored in the storage medium 35 is referred to as toner characteristic information A and the toner characteristic information stored in the main body of the image forming apparatus 100 is referred to as toner characteristic information B. When the toner characteristic information A is not distinguished from the toner characteristic information B, the toner characteristic information A and the toner characteristic information B are expressed as the toner characteristic information. In the image forming apparatus 100, when the toner cartridge 30 is set in the image forming apparatus 100 and a cover storing the toner cartridge 30 is closed, the toner characteristic information A can be acquired from the toner cartridge 30. The acquired toner characteristic information A is stored as the toner characteristic information B in the image forming apparatus 100.

The above-described toner supply motor 31, the reading and writing unit 36, and the detection sensor 37 are controlled by the control unit 400.

Figures 3, 4:
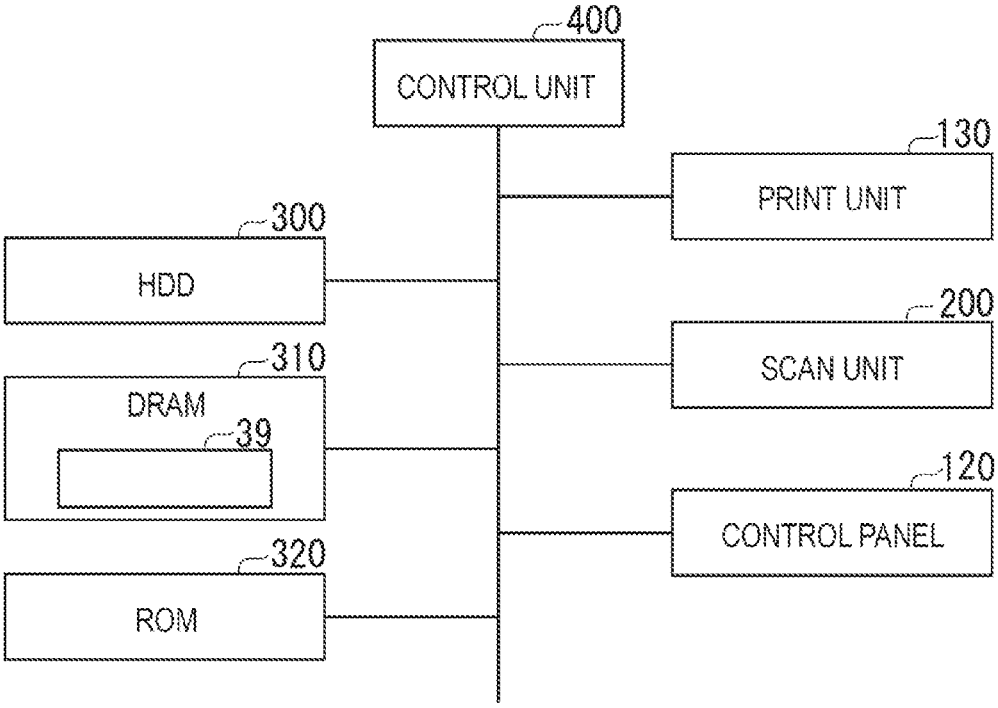
FIG. 3 is a diagram illustrating a configuration of a control system of the image forming apparatus.
FIG. 4 is a diagram illustrating a data structure of toner characteristic information.

FIG. 3 is a diagram illustrating a configuration of a control system of the image forming apparatus 100. The image forming apparatus 100 includes the print unit 130, the scan unit 200, the control panel 120, the control unit 400, a hard disk drive (HDD) 300, a dynamic random access memory (DRAM) 310, and a read-only memory (ROM) 320. These units are connected via a system bus.

The ROM 320 stores various control programs necessary for the image forming apparatus 100 to operate. The ROM 320 stores each program controlling an image forming operation and a remaining amount of toner management operation. The execution of each program is controlled by the control unit 400. The DRAM 310 is a buffer memory that temporarily stores data generated at the time of execution of each program. A region 39 of the DRAM 310 is a region in which the toner characteristic information B is stored.

The control unit 400 is directly or indirectly connected at least to the detection sensor 37 illustrated in FIG. 2, a temperature and/or humidity sensor, the reading and writing unit 36, and the toner supply motor 31. The control unit 400 controls an operation of each unit connected via the system bus and each unit related to management of a remaining amount of toner.

Next, a remaining amount information derivation process of deriving remaining amount information regarding a remaining amount of toner in the toner cartridge 30 will be described. In the remaining amount information derivation process, the toner characteristic information is acquired. In the remaining amount information derivation process, a physical amount proportional to a running amount of the toner supply motor 31 is acquired. The physical amount is an amount determined in accordance with an amount of toner stored in the development device 14. In the embodiment, a counter is used as the physical amount proportional to a running amount of the toner supply motor 31. The counter is an amount determined from a running time of the toner supply motor 31 and is directly proportional to the running time.

Figures 5, 6:
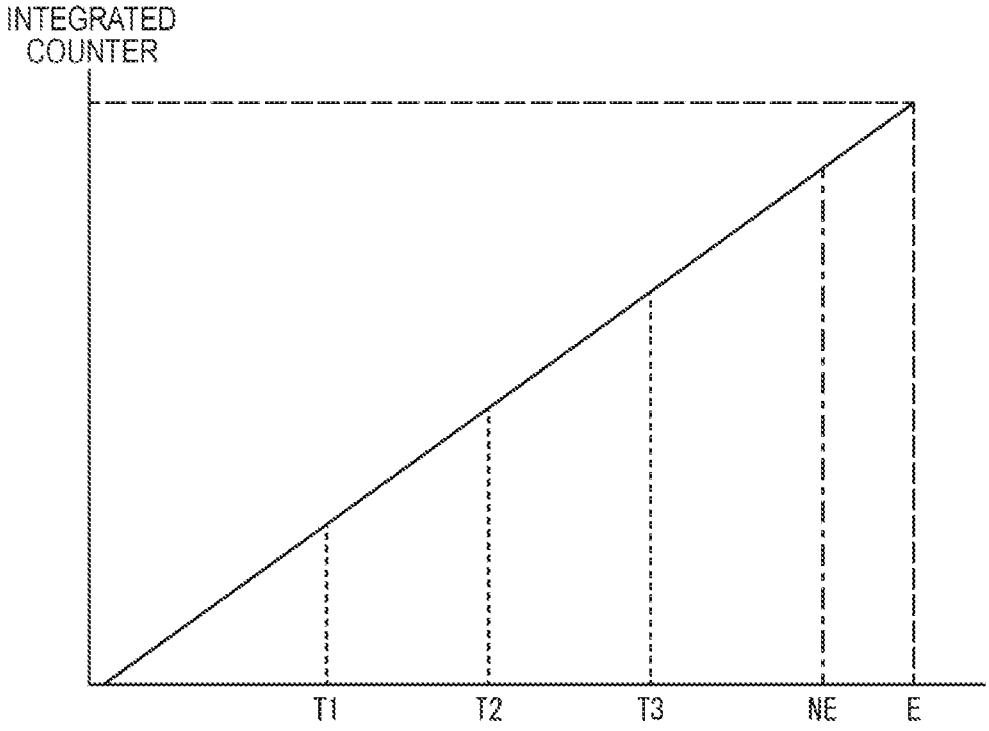
FIG. 5 is a diagram illustrating a data structure of toner characteristic information.
FIG. 6 is a diagram illustrating details of threshold information.

First, details of the above-described toner characteristic information will be described. FIG. 4 is a diagram illustrating a data structure of the toner characteristic information A. FIG. 5 is a diagram illustrating a data structure of the toner characteristic information B. As illustrated in FIGS. 4 and 5, the toner characteristic information A and the toner characteristic information B have the same data structure. A1 to A4 illustrated in FIG. 4 and B1 to B4 illustrated in FIG. 5 indicate a heading address in which each piece of data is stored.

The toner characteristic information includes at least an identification code, threshold information, a correction coefficient, and an integrated counter. The identification code is information for identifying the toner cartridge 30. The threshold information is information indicating a threshold serving as a reference of a remaining amount. The correction coefficient is a coefficient determined in accordance with characteristics of an external additive added to toner. The correction coefficient is a coefficient calculated with a counter. The integrated counter is an integration value of counters. The correction coefficient is an example of external additive characteristic information.

In this way, the toner characteristic information is information determined in accordance with characteristics of toner and an external additive. The toner characteristic information is information for deriving remaining amount information regarding a remaining amount of toner in the toner cartridge 30. When the toner characteristic information has items of at least the identification code, the threshold information, the correction coefficient, and the integrated counter, the toner characteristic information A and the toner characteristic information B may have different data structures.

FIG. 6 is a diagram illustrating details of threshold information. The threshold information includes T1 to T3, NE, and E. T1 to T3, NE, and E are values to be compared with an integrated counter. As the integrated counter is larger, more toner is supplied by the toner supply motor 31. The integrated counter is an example of remaining amount information.

The remaining amount of toner is expressed at four stages by three thresholds including thresholds T1, T2, and T3. The thresholds T1, T2, and T3 indicate less remaining amounts in this order. The threshold NE indicates that toner is nearly used up. The threshold E indicates that toner is used up.

In general, in the image forming apparatus, an error occurs in some cases between a remaining amount of toner estimated from a value of the integrated counter and an actual remaining amount of toner in a toner cartridge. The main cause of this error is that a discharge amount of toner from a toner cartridge to a development device is not constant due to a variation in bulk density of toner filling each toner cartridge.

Even when toner is generated based on prescription and a condition determined in advance, bulk density of the toner may vary based on characteristics of an external additive added to the toner. In general, an external additive which is a fluidization material is added to base particles of toner at a constant ratio. The fluidization material is, for example, silica (silicon dioxide) or the like. The characteristics of the external additive are, for example, an "external additive coverage factor" and "external additive adhesion intensity."

In the image forming apparatus 100 according to the embodiment, an error between a remaining amount of toner estimated from a value of an integrated counter and an actual remaining amount of toner in a toner cartridge 30 is reduced in consideration of a change in bulk density of toner occurring due to characteristics of an external additive. In the image forming apparatus 100, the error is reduced by correcting a remaining amount of toner using the above-described correction coefficient. The correction coefficient is determined in accordance with characteristics of an external additive added to toner.

First, an embodiment in which an "external additive coverage factor" is used as characteristics of an external additive will be described. In general, a particle size distribution of toner with which a toner cartridge is filled differs for each toner cartridge. For example, a particle size distribution of toner differs for each production lot. This is mainly caused due to a change in a fine powder amount of the toner. When a particle size distribution of toner differs, a surface area of base particles of the toner differs. Thus, the external additive coverage factor of the toner with which the toner cartridge is filled varies for each toner cartridge.

The external additive coverage factor can be expressed by a ratio of a projected area of an external additive added to toner to a surface area of base particles of the toner as in Expression (1) below.

$$\text{(External additive coverage factor)}=\text{(Projected area of external additive)}/\text{(Surface area of toner)} \quad (1)$$

With a change in an external additive coverage factor, bulk density of toner with which the toner cartridge 30 is filled changes.

Figures 7, 8, 9:
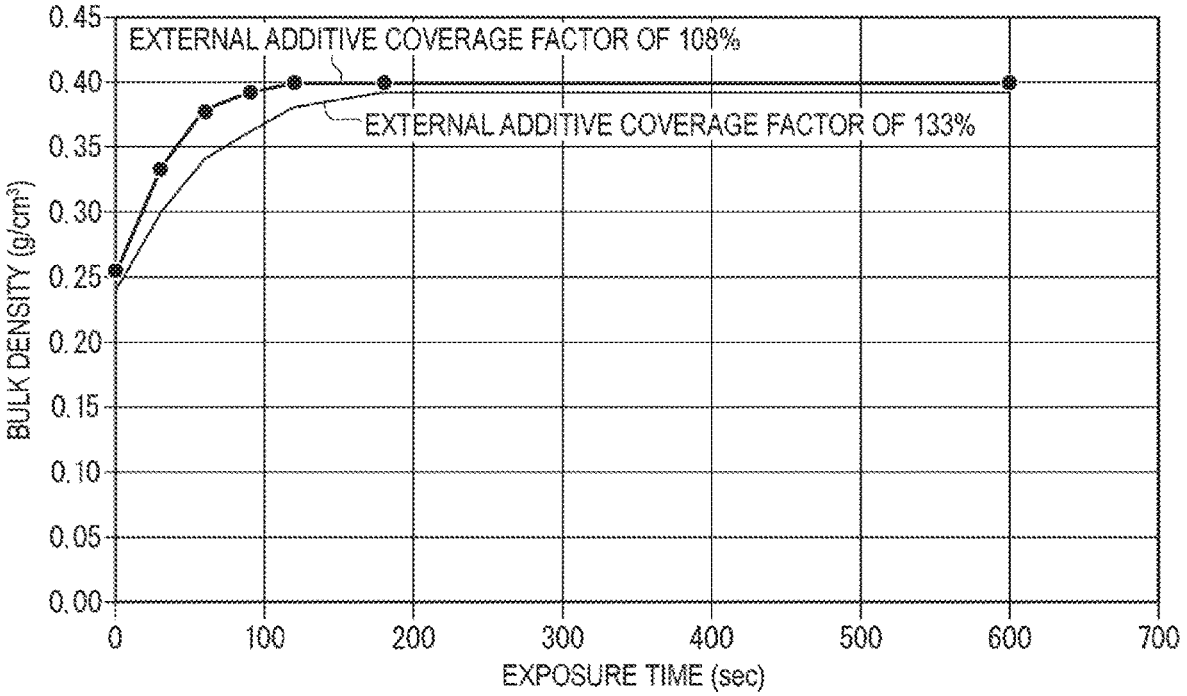
FIG. 7 is a diagram illustrating an example of a measurement result of bulk density of toner at each external additive coverage factor.
FIG. 8 is a diagram illustrating an example of a relationship between the external additive coverage factor and a correction coefficient.
FIG. 9 is a diagram illustrating another example of the relationship between the external additive coverage factor and the correction coefficient.

FIG. 7 is a diagram illustrating an example of a measurement result of bulk density of toner at various external additive coverage factors. Here, a measurer filled a graduated cylinder of 50 milliliters (ml) with toner of 10 grams (g). The measurer measured bulk density of toner changing over time after waving and stirring a graduated cylinder with a cover vertically 50 times. As illustrated in FIG. 7, immediately after the graduated cylinder is stirred, the bulk density of the toner is relatively low. This is because the toner holds air. After the stirring, the bulk density of the toner changes to be relatively higher over time, and the bulk density of the toner does not change at a certain time point. This is because the air held by the toner is lost and the toner becomes tight.

Here, the measurer measured bulk density of toner of which an external additive coverage factor was 133% and bulk density of toner which an external additive coverage factor was 108%. As illustrated in FIG. 7, a value of the bulk density of the toner with the external additive coverage factor of 133% is lower than that of the toner with the external additive coverage factor of 108%.

Due to a difference in the bulk density, an actual discharge amount of toner to the development device 14 differs even when a counter is the same. When the bulk density is higher, a relatively greater amount of toner is discharged. When the bulk density is lower, a relatively lesser amount of toner is discharged. Thus, an error may occur between a remaining amount of toner estimated from an integrated counter and an actual remaining amount of toner in the toner cartridge 30 if this is not taken into consideration when estimating the remaining amount of toner.

Accordingly, in the embodiment, occurrence of the error is curbed using a correction coefficient illustrated in FIGS. 8 and 9. A correction coefficient illustrated in FIG. 8 is a correction coefficient used when the integrated counter of the toner characteristic information B is updated. A correction coefficient illustrated in FIG. 9 is a correction coefficient used when a counter at the time of supply of the toner to the development device 14 is controlled. To distinguish the two correction coefficients from each other, the correction coefficient illustrated in FIG. 8 is expressed as an "integration updating correction coefficient" in some cases. A correction coefficient illustrated in FIG. 9 is expressed as a "supply counter correction coefficient" in some cases.

The integration updating correction coefficient illustrated in FIG. 8 will be described. A value of the correction coefficient is determined in advance in accordance with an external additive coverage factor of the toner. As illustrated in FIG. 8, for example, when the external additive coverage factor is in the range of 131% to 135%, the correction coefficient is 0.95. For example, when the external additive coverage factor is in the range of 111% to 130%, the correction coefficient is 1.00. For example, when the external additive coverage factor is in the range of 105% to 110%, the correction coefficient is 1.05.

For example, before the toner cartridge 30 is filled with toner, the external additive coverage factor of the toner is measured. Then, a correction coefficient corresponding to the measured external additive coverage factor is stored in advance in the toner characteristic information A of which a data structure is illustrated in FIG. 4.

The control unit 400 acquires a counter corresponding to the presently discharged toner after the toner is discharged to the development device 14 by the toner supply motor 31. The control unit 400 sets a product of the acquired counter and the integration updating correction coefficient as a corrected counter and adds the corrected counter to an integrated counter of the toner characteristic information B.

In this configuration, the image forming apparatus 100 corrects a value added to the integrated counter of the toner characteristic information to a smaller value when a relatively lesser amount of toner is discharged in response to the external additive coverage factor being higher (e.g., if the bulk density is lower). Conversely, the image forming apparatus 100 corrects a value added to the integrated counter of the toner characteristic information to a larger value when a relatively greater amount of toner is discharged in response to the external additive coverage factor being lower (e.g., if the bulk density is higher). Thus, the image forming apparatus 100 can curb occurrence of an error between a remaining amount of toner estimated from the integrated counter and the actual remaining amount of toner in the toner cartridge.

The supply counter correction coefficient illustrated in FIG. 9 will be described. As in the integration updating correction coefficient illustrated in FIG. 8, a value of the supply counter correction coefficient is determined in advance in accordance with the external additive coverage factor of the toner. As illustrated, the supply counter correction coefficient illustrated in FIG. 9 is a reciprocal of the integration updating correction coefficient illustrated in FIG. 8.

The control unit 400 obtains a discharge amount from the amount of toner detected by the detection sensor 37 when the toner is discharged to the development device 14 by the toner supply motor 31.

The control unit 400 acquires a counter of the toner supply motor 31 necessary to discharge toner corresponding to a discharge amount. The control unit 400 sets a product of the acquired counter and the supply counter correction coefficient as a corrected counter and causes the toner supply motor 31 to run by the corrected counter.

In this configuration, the image forming apparatus 100 corrects a counter at the time of running of the toner supply motor 31 to a larger counter when a relatively lesser amount of toner will be discharged in response to the external additive coverage factor being higher (e.g., if the bulk density is lower). Conversely, the image forming apparatus 100 corrects a counter at the time of running of the toner supply motor 31 to a smaller counter when a relatively greater amount of toner will be discharged in response to the external additive coverage factor being lower (e.g., if the bulk density is higher). Thus, the image forming apparatus 100 can curb occurrence of an error between a remaining amount of toner estimated from the integrated counter and the actual remaining amount of toner in the toner cartridge.

Hereinafter, an example will be described. Here, the measurer caused the image forming apparatus 100 to perform a toner supply operation until a displayed remaining amount displayed on each control panel 140 was 15% when the correction was performed using the supply counter correction coefficient and when the correction was not performed. Then, the measurer measured each actual remaining amount of toner at a time point at which the displayed remaining amount was 15% and performed comparison of these remaining amounts. Hereinafter, the measurement condition and procedure will be described in detail.

The measurer performed measurements in the following condition and procedure.

[1] The measurer measured a particle size distribution of toner using a Multisizer 3 which is a precise particle size distribution measurement apparatus manufactured by a Beckman Coulter, Inc.

[2] The measurer set an addition amount of toner to 100 wt % and calculated a surface area of toner per unit volume from the measured particle size distribution and true specific gravity of the toner. For example, when the true specific gravity of the toner is 1.1 g/cm$^3$ and an average diameter R1 is 8.0 micrometers (μm), the measurer performed calculation as follows.

$$100\times(10000)^3/\{1.1\times(4/3)\pi(R1)/2)^3\}=3.34E9 \text{ pieces} \quad \text{(Number per unit volume of toner):}$$

$$4\pi((R1)/2)^2\times3.34E9=6.82E11\ \mu m^2 \quad \text{(Surface area of toner):}$$

The measurer corrected the calculated surface area in accordance with a fine power amount of toner.

[3] The measurer calculated a projected area (cross-sectional area) based on true specific gravity of an external additive addition amount with respect to toner of 100 wt % and an average diameter in each external additive to be used. For example, when NAX 50, which is a hydrophobic fumed silica produced by Aerosil Co., Ltd., is added by 1.2 wt % as an external additive and the true specific gravity of toner is 2.2 g/cm$^3$, and an average diameter R2 is 0.03 μm, the measurer performed calculation as follows.

$$1.2\times(10000)^3/\{2.2\times(4/3)\pi(R2)/2)^3\}=3.86E14 \text{ pieces} \quad \text{(Number per unit volume of NAX 50):}$$

$$\pi(R2)/2)^2\times3.86E14=2.73E11\ \mu m^2 \quad \text{(Projected area of NAX 50):}$$

[4] The measurer summed the projected areas of all the external additives.

[5] The measurer calculated an external additive coverage factor by Expression (2) below.

$$\text{(External additive coverage factor)}=\text{(Projected area sum of all external additives)/(Toner surface area)} \quad (2)$$

Accordingly, for example, a coverage factor of NAX 50 is calculated as follows.

$$2.73E11/6.82E11=0.4=40\% \quad \text{(Coverage factor of NAX 50):}$$

[6] The measurer included the supply counter correction coefficient in accordance with the calculated external additive coverage factor in the toner characteristic information A and stored the toner characteristic information A in the storage medium 35 (e.g., an integrated circuit (IC) chip) of the toner cartridge 30. The measurer used the correction coefficient illustrated in FIG. 9 as the supply counter correction coefficient.

[7] The measurer caused the image forming apparatus 100 to perform the toner supply operation until the displayed remaining amount of toner was 15% and measured an actual remaining amount of toner at that time point. The measurer measured a weight of the toner cartridge 30 taken out from the image forming apparatus 100 and measured a remaining amount of toner [%] based on comparison with the weight of the toner cartridge 30 before being loaded in the image forming apparatus 100.

Figures 10, 11:
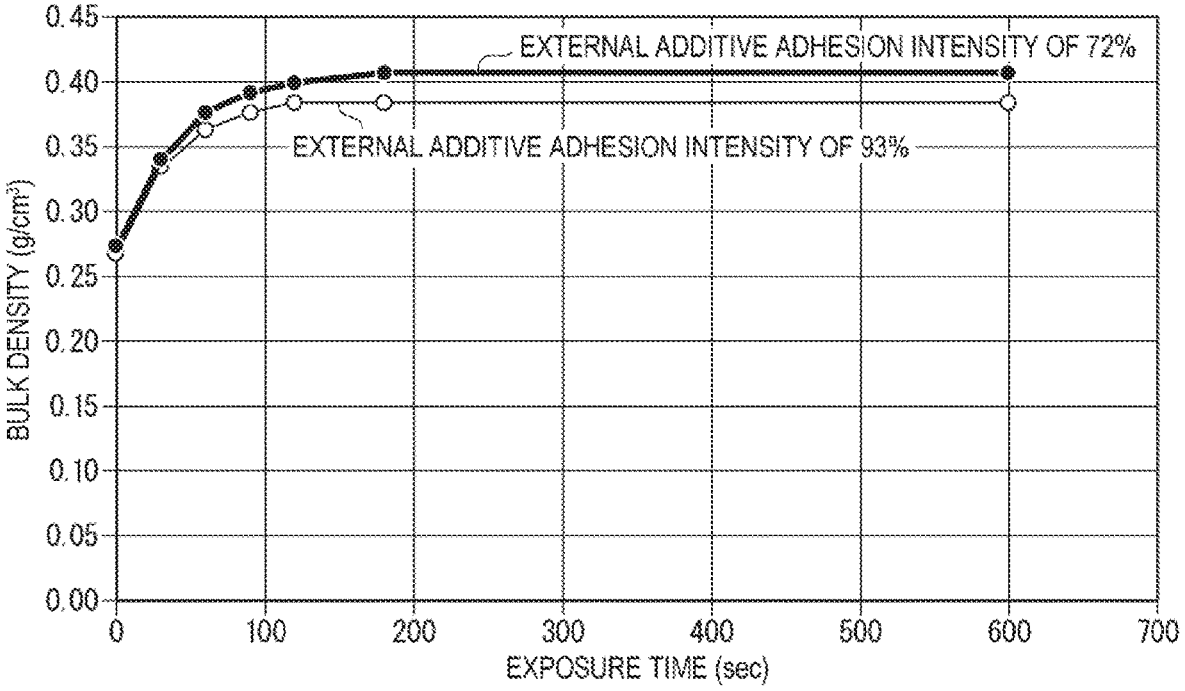
FIG. 10 is a diagram illustrating a measurement result in a correction performed using a supply counter correction coefficient based on the external additive coverage factor.
FIG. 11 is a diagram illustrating an example of a measurement result of bulk density of toner for each external additive adhesion intensity.

Hereinafter, a measurement result of the measurement in the condition and the procedure will be described. FIG. 10 is a diagram illustrating a measurement result in correction performed using a supply counter correction coefficient based on the external additive coverage factor. FIG. 10 illustrates each measurement result when toner with each of external additive coverage factors of 120%, 133%, and 108% is loaded in the image forming apparatus 100 and the correction is performed using the supply counter correction coefficient illustrated in FIG. 9. FIG. 10 also illustrates each measurement result when toner with each of external additive coverage factors of 133% and 108% is loaded in the image forming apparatus 100 and the correction is not performed.

First, the measurement result when the correction was performed will be described. When the external additive coverage factor was 120%, a value of 1.00 was used as the supply counter correction coefficient, as illustrated in FIG. 9. In this case, the actual remaining amount of toner when the displayed remaining amount was 15% was 15%. When the external additive coverage factor was 133%, a value of 1.05 was used as the supply counter correction coefficient, as illustrated in FIG. 9. In this case, the actual remaining amount of toner when the displayed remaining amount was 15% was 15%. When the external additive coverage factor was 108%, a value of 0.95 was used as the supply counter correction coefficient, as illustrated in FIG. 9. In this case, the actual remaining amount of toner when the displayed remaining amount was 15% was 15%. In this way, in the three measurements when the correction was performed, an error between an actual remaining amount of toner and a displayed remaining amount did not occur.

Next, the measurement result when the correction was not performed will be described. When the external additive coverage factor was 133%, an actual remaining amount of toner when the displayed remaining amount was 15% was 23%. When the external additive coverage factor was 108%, an actual remaining amount of toner when the displayed remaining amount was 15% was 8%. In this way, in the two measurements when the correction was not performed, an error of ±8% between an actual remaining amount of toner and a displayed remaining amount occurred.

Next, an embodiment in which "external additive adhesion intensity" is used as characteristics of an external additive will be described. In general, bulk density of toner changes in some cases depending on an environment when toner is manufactured. For example, in an external additive mixing process, bulk density of toner is higher, for example, when the toner is continuously produced and when a temperature of an external additive mixing apparatus increases (e.g., in summer). This is caused since an external additive is more strongly embedded in base particles of the toner. In this way, external additive adhesion intensity of the toner with which a toner cartridge is filled varies for each toner cartridge. The variation in the external additive adhesion intensity results in a change in the bulk density of the toner with which the toner cartridge 30 is filled.

FIG. 11 is a diagram illustrating an example of a measurement result of bulk density of the toner for each external additive adhesion intensity. Here, a measurer filled a graduated cylinder of 50 ml with toner of 10 g. The measurer measured bulk density of toner changing over time after waving and stirring a graduated cylinder with a cover vertically 50 times. As illustrated in FIG. 11, immediately after the graduated cylinder is stirred, the bulk density of the toner is relatively low. This is because the toner holds air. After the stirring, the bulk density of the toner changes to be relatively higher over time, and the bulk density of the toner does not change at a certain time point. This is because the air held by the toner is lost and the toner becomes tight.

Here, the measurer measured bulk density of toner with external additive adhesion intensity of 93% and bulk density of toner with external additive adhesion intensity of 72%. As illustrated in FIG. 11, a value of the bulk density of the toner with the external additive adhesion intensity of 93% is lower than that of the toner with the external additive adhesion intensity of 72%.

Due to a difference in the bulk density, an actual discharge amount of toner to a development device differs even when a counter is the same. When the bulk density is higher, a relatively greater amount of toner is discharged. When the bulk density is lower, a relatively lesser amount of toner is discharged. Thus, an error occurs between a remaining amount of toner estimated from an integrated counter and an actual remaining amount of toner in the toner cartridge if this is not taken into consideration when estimating the remaining amount of toner.

Accordingly, in the embodiment, occurrence of the error is curbed using a correction coefficient illustrated in FIGS. 12 and 13. A correction coefficient illustrated in FIG. 12 is a correction coefficient used when the integrated counter of the toner characteristic information B is updated. A correction coefficient illustrated in FIG. 13 is a correction coefficient used when a counter at the time of supply of the toner to the development device 14 is controlled. To distinguish the two correction coefficients from each other, the correction coefficient illustrated in FIG. 12 is expressed as an "integration updating correction coefficient" in some cases. A correction coefficient illustrated in FIG. 13 is expressed as a "supply counter correction coefficient."

The integration updating correction coefficient illustrated in FIG. 12 will be described. A value of the correction coefficient is determined in advance in accordance with external additive adhesion intensity of toner. As illustrated in FIG. 12, for example, when external additive adhesion intensity is in the range of 91% to 95%, a correction coefficient is 0.93. For example, when external additive adhesion intensity is in the range of 76% to 90%, a correction coefficient is 1.00. For example, when external additive adhesion intensity is in the range of 71% to 75%, a correction coefficient is 1.07.

For example, before the toner cartridge 30 is filled with toner, the external additive adhesion intensity of the toner is measured. Then, a correction coefficient corresponding to the measured external additive adhesion intensity is stored in advance in the toner characteristic information A that has the data structure of FIG. 4.

The control unit 400 acquires a counter corresponding to a presently discharged toner after the toner is discharged to the development device 14 by the toner supply motor 31. The control unit 400 sets a product of the acquired counter and the integration updating correction coefficient as a corrected counter and adds the corrected counter to an integrated counter of the toner characteristic information B.

In this configuration, the image forming apparatus 100 corrects a value added to the integrated counter of the toner characteristic information to a smaller value when a relatively lesser amount of toner is discharged in response to the external additive adhesion intensity being higher (e.g., if the bulk density is lower). Conversely, the image forming apparatus 100 corrects a value added to the integrated counter of the toner characteristic information to a larger value when a relatively greater amount of toner is discharged in response to the external additive adhesion intensity being lower (e.g., if the bulk density is higher). Thus, the image forming apparatus 100 can curb occurrence of an error between a remaining amount of toner estimated from the integrated counter and the actual remaining amount of toner in the toner cartridge 30.

The supply counter correction coefficient illustrated in FIG. 13 will be described. As in the integration updating correction coefficient illustrated in FIG. 12, a value of the supply counter correction coefficient is determined in advance in accordance with the external additive adhesion intensity of the toner. As illustrated, the supply counter correction coefficient illustrated in FIG. 13 is a reciprocal of the integration updating correction coefficient illustrated in FIG. 12.

The control unit 400 obtains a discharge amount from the amount of toner detected by the detection sensor 37 when the toner is discharged to the development device 14 by the toner supply motor 31.

The control unit 400 acquires a counter of the toner supply motor 31 necessary to discharge toner corresponding to a discharge amount. The control unit 400 sets a product of the acquired counter and the supply counter correction coefficient as a corrected counter and causes the toner supply motor 31 to run by the corrected counter.

In this configuration, the image forming apparatus 100 corrects a counter at the time of running of the toner supply motor 31 to a larger counter when a relatively lesser amount of toner will be discharged in response to the external additive adhesion intensity being higher (e.g., if the bulk density is lower). Conversely, the image forming apparatus 100 corrects a counter at the time of running of the toner supply motor 31 to a smaller counter when a relatively greater amount of toner will be discharged in response the external additive adhesion intensity being lower (e.g., the bulk density is higher). Thus, the image forming apparatus 100 can curb occurrence of an error between a remaining amount of toner estimated from the integrated counter and the actual remaining amount of toner in the toner cartridge.

Hereinafter, an example will be described. Here, the measurer caused the image forming apparatus 100 to perform a toner supply operation until a displayed remaining amount displayed on each control panel 140 was 15% when the correction was performed using the supply counter correction coefficient and when the correction was not performed. Then, the measurer measured each actual remaining amount of toner at a time point at which the displayed remaining amount was 15% and performed a comparison of these remaining amounts. Hereinafter, a measurement condition and procedure will be described in detail.

The measurer performed measurement in the following condition and procedure.

[1] In general, in particles of an external additive added to toner, there are not only particles attached to the surfaces of base particles of the toner but also particles coexisting with unattached base particles of the toner and particles that are floating. The measurer removed an external additive unattached to toner by performing cyclone classification on the toner using an I-2 air-flow classifier manufactured by Nippon Pneumatic MFG. Co., LTD. At this time, the measurer set a suction-blow force to a value in the range of 100 to 200 $mmH_2O$ and set a toner processing speed to 0.3 kg/H.

[2] The measurer measured silicon (Si) intensity of each of toner before a cyclone classification process and toner after the cyclone classification process using a fluorescent X-ray (XRF).

[3] The measurer calculated external additive adhesion intensity by Expression (3) below.

$$(\text{External additive adhesion intensity } \%)=100\times(\text{Si intensity after cyclone classification process})/(\text{Si intensity before cyclone classification process}) \quad (3)$$

For example, when the Si intensity of the toner before the cyclone classification process is 40 kcps and the Si intensity after the cyclone classification process is 32 kcps, the external additive adhesion intensity is 100×32/40=80%.

[4] The measurer included the supply counter correction coefficient in accordance with the calculated external additive adhesion intensity in the toner characteristic information A and stored the toner characteristic information A in the storage medium 35 (an IC chip) of the toner cartridge 30. The measurer used the correction coefficient illustrated in FIG. 13 as the supply counter correction coefficient.

[5] The measurer caused the image forming apparatus 100 to perform the toner supply operation until the displayed remaining amount of toner was 15% and measured an actual remaining amount of toner at that time point. The measurer measured a weight of the toner cartridge 30 taken out from the image forming apparatus 100 and measured a remaining amount of toner [%] based on comparison with the weight of the toner cartridge 30 before being loaded in the image forming apparatus 100.

Hereinafter, a measurement result of the measurement in the condition and the procedure will be described. FIG. 14 is a diagram illustrating a measurement result in correction performed using a supply counter correction coefficient based on the external additive adhesion intensity. FIG. 14 illustrates each measurement result when toner with each of external additive coverage factors of 85%, 93%, and 72% was loaded in the image forming apparatus 100 and the correction was performed using the supply counter correction coefficient illustrated in FIG. 13. FIG. 14 also illustrates each measurement result when toner with each of external additive coverage factors of 93% and 72% was loaded in the image forming apparatus 100 and the correction was not performed.

First, the measurement result when the correction is performed will be described. When the external additive adhesion intensity was 85%, a value of 1.00 was used as the supply counter correction coefficient, as illustrated in FIG. 13. In this case, the actual remaining amount of toner when the displayed remaining amount was 15% was 15%. When the external additive adhesion intensity was 93%, a value of 1.07 is used as the supply counter correction coefficient, as illustrated in FIG. 13. In this case, the actual remaining amount of toner when the displayed remaining amount was 15% was 15%. When the external additive adhesion intensity was 72%, a value of 0.93 was used as the supply counter correction coefficient, as illustrated in FIG. 13. In this case, the actual remaining amount of toner when the displayed remaining amount was 15% was 15%. In this way, in the three measurements when the correction was performed, an error between an actual remaining amount of toner and a displayed remaining amount did not occur.

Next, the measurement result when the correction is not performed will be described. When the external additive adhesion intensity was 93%, an actual remaining amount of toner when the displayed remaining amount was 15% was 23%. When the external additive adhesion intensity was 72%, an actual remaining amount of toner when the displayed remaining amount was 15% was 8%. In this way, in the two measurements when the correction was not performed, an error of ±8% between an actual remaining amount of toner and a displayed remaining amount occurred.

Next, a flow of a remaining amount information derivation process will be described. The correction coefficients include the integration updating correction coefficient and the supply counter correction coefficient, and the remaining amount information derivation processes for the coefficients are different. First, a flow of the remaining amount information derivation process when the integration updating correction coefficient is used will be described.

Figure 15:
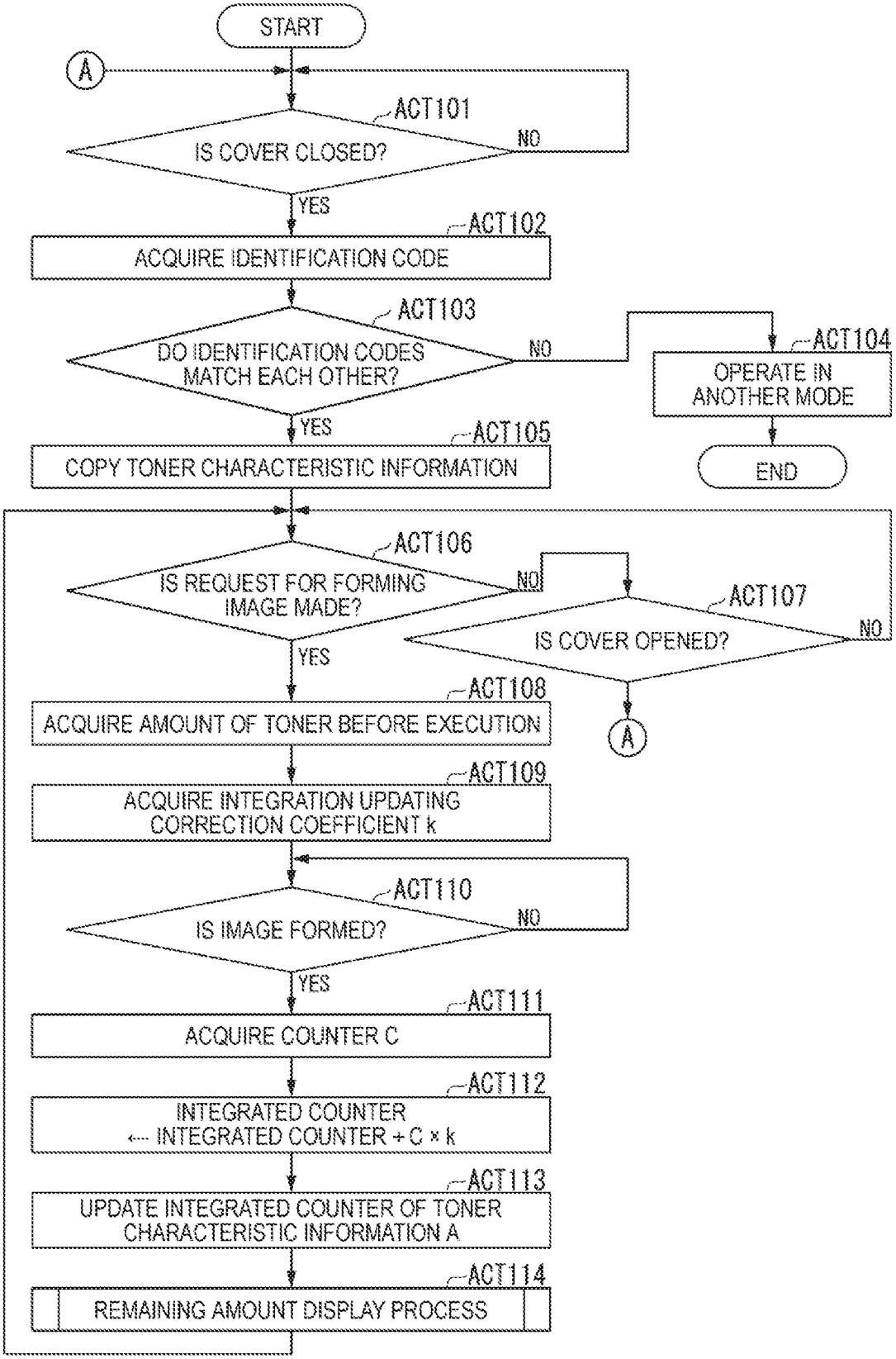
FIG. 15 is a flowchart illustrating a flow of a remaining amount information derivation process performed by a control unit when an integration updating correction coefficient is used.

FIG. 15 is a flowchart illustrating a flow of a remaining amount information derivation process performed by the control unit 400 when an integration updating correction coefficient is used. The control unit 400 determines whether the cover storing the toner cartridge 30 is closed (ACT101). When the cover is closed (YES in ACT101), an identification code of the toner characteristic information A is acquired (ACT102).

The control unit 400 determines whether the acquired identification code matches an identification code of the toner characteristic information B (ACT103). When the acquired identification code does not match the identification code of the toner characteristic information B (NO in ACT103), the control unit 400 operates in another mode in which a process related to the remaining amount of toner is not performed (ACT104) and ends the process. A case where the identification codes do not match each other is a case where a set toner cartridge is a counterfeit product or the like.

When the acquired identification code matches the identification code of the toner characteristic information B (YES in ACT103), the control unit 400 copies the toner characteristic information A to the toner characteristic information B (ACT105).

The control unit 400 determines whether a request for forming an image is made in accordance with an instruction or the like from the user (ACT106). When the request for forming an image is not made (NO in ACT106), the control unit 400 determines whether the cover is opened (ACT107). When the cover is opened (YES in ACT107), the process returns to ACT101. When the cover is not opened (NO in ACT107), the process returns to ACT106.

When the request for forming an image is made (YES in ACT106), the control unit 400 acquires a toner amount indicating an amount of toner stored in the development device 14 before the image is formed (ACT108). The toner amount is detected by the detection sensor 37. The control unit 400 acquires an integration updating correction coefficient k from the toner characteristic information B (ACT 109).

When the image is formed (YES in ACT110), the control unit 400 acquires a counter C corresponding to a present supply amount (ACT111). The control unit 400 updates an integrated counter of the toner characteristic information B by setting a value obtained by adding a product of the counter C and the integration updating correction coefficient k to the integrated counter of the toner characteristic information B as a new integrated counter (ACT112). In this way, the control unit 400 derives remaining amount information regarding a remaining amount of toner in the toner cartridge 30 based on the acquired counter and the correction coefficients of the toner characteristic information. The integrated counter is information obtained by integrating a product of the counter and the correction coefficients.

The control unit 400 updates the integrated counter of the toner characteristic information A by overwriting the integrated counter of the toner characteristic information B on the integrated counter of the toner characteristic information A (ACT113).

The control unit 400 performs the remaining amount display process of displaying the remaining amount of toner on the display 110 (ACT114) and returns the process to ACT106.

As illustrated in FIG. 15, since the value of the integrated counter can be obtained in accordance with the actual discharge amount by using the integration updating correction coefficient, the image forming apparatus 100 can curb occurrence of an error.

Figure 16:
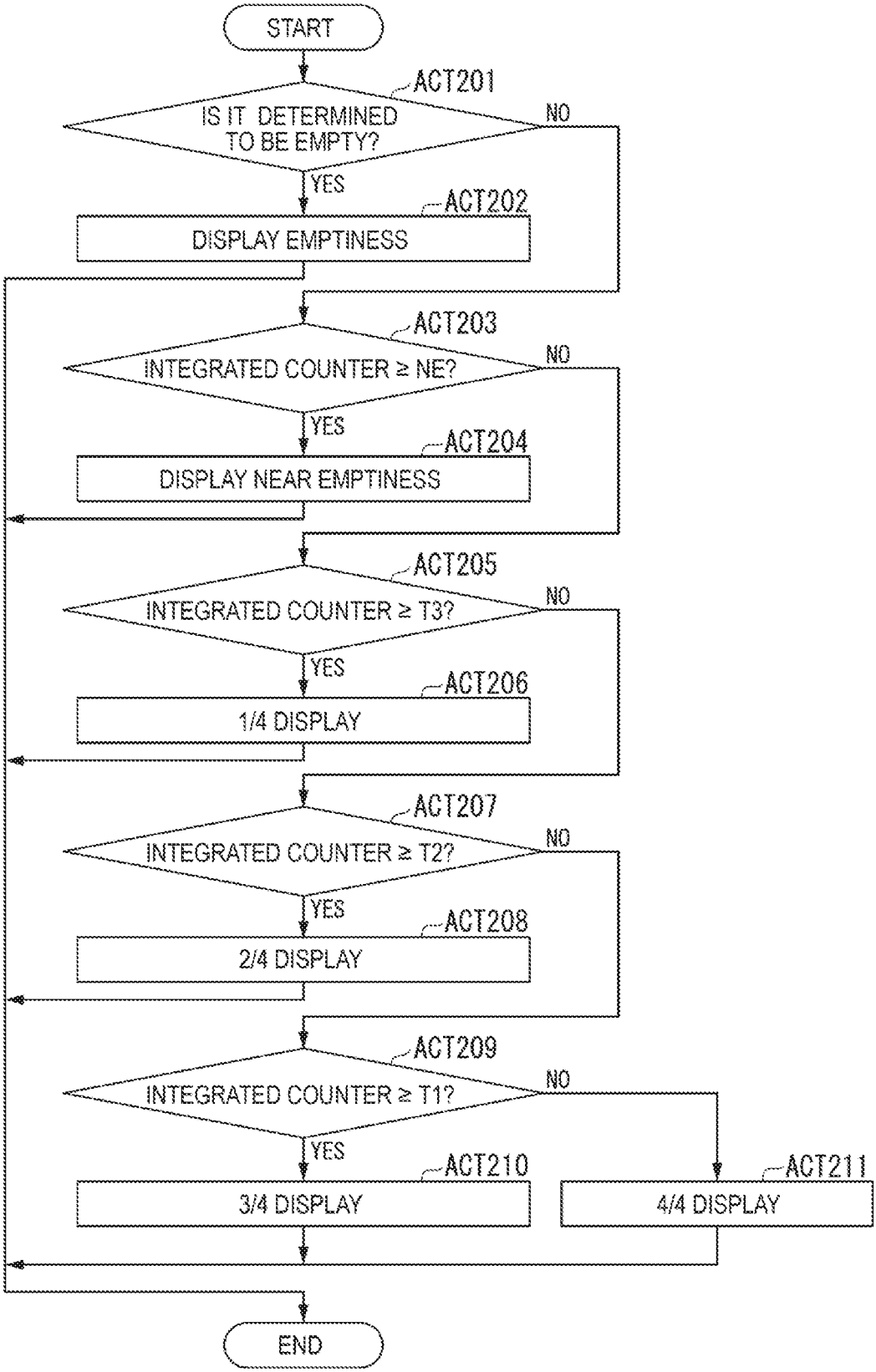
FIG. 16 is a flowchart illustrating a flow of a remaining amount display process.

Next, a flow of the remaining amount display process will be described. FIG. 16 is a flowchart illustrating a flow of a remaining amount display process performed by the control unit 400. The control unit 400 determines whether the toner cartridge 30 is empty (ACT201). When the detection sensor 37 may not confirm an increase in an amount of toner despite supply of the toner, the control unit 400 determines that the toner cartridge 30 is empty.

When the control unit 400 determines that the toner cartridge 30 is empty (YES in ACT201), the control unit 400 displays the emptiness on the display 110 (ACT202) and ends the process.

When the control unit 400 determines that the toner cartridge 30 is not empty (NO in ACT201), the control unit 400 determines whether the integrated counter is equal to or greater than the threshold NE (ACT203). When the integrated counter is equal to or greater than the threshold NE (YES in ACT203), the control unit 400 displays near emptiness on the display 110 (ACT204) and ends the process.

When the integrated counter is not equal to or greater than the threshold NE (NO in ACT203), the control unit 400 determines whether the integrated counter is equal to or greater than the threshold T3 (ACT205). When the integrated counter is equal to or greater than the threshold T3 (YES in ACT205), the control unit 400 performs 1/4 display indicating that the remaining amount is about ¼ on the display 110 (ACT206) and ends the process.

When the integrated counter is not equal to or greater than the threshold T3 (NO in ACT205), the control unit 400 determines whether the integrated counter is equal to or greater than the threshold T2 (ACT207). When the integrated counter is equal to or greater than the threshold T2 (YES in ACT207), the control unit 400 performs 2/4 display indicating that the remaining amount is about 2/4 on the display 110 (ACT208) and ends the process.

When the integrated counter is not equal to or greater than the threshold T2 (NO in ACT207), the control unit 400 determines whether the integrated counter is equal to or greater than the threshold T1 (ACT209). When the integrated counter is equal to or greater than the threshold T1 (YES in ACT209), the control unit 400 performs 3/4 display indicating that the remaining amount is about 3/4 on the display 110 (ACT210) and ends the process.

When the integrated counter is not equal to or greater than the threshold T1 (NO in ACT209), the control unit 400 performs 4/4 display indicating that the remaining amount is about 4/4 on the display 110 (ACT211) and ends the process.

Figure 17:
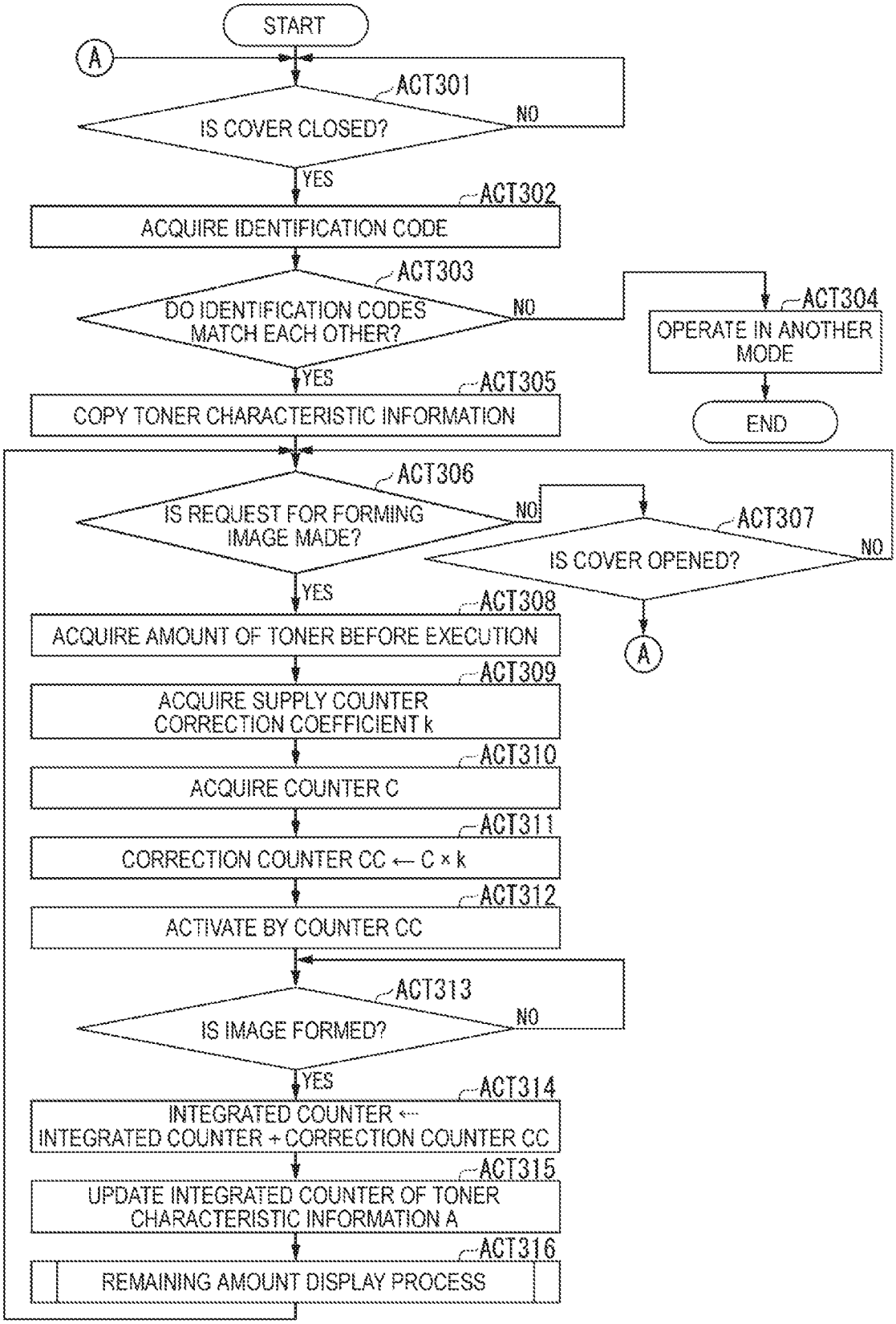
FIG. 17 is a flowchart illustrating a flow of a remaining amount information derivation process performed by the control unit when a supply counter correction coefficient is used.

FIG. 17 is a flowchart illustrating a flow of a remaining amount information derivation process performed by the control unit 400 when a supply counter correction coefficient is used. The control unit 400 determines whether the cover storing the toner cartridge 30 is closed (ACT301). When the cover is closed (YES in ACT301), an identification code of the toner characteristic information A is acquired (ACT302).

The control unit 400 determines whether the acquired identification code matches an identification code of the toner characteristic information B (ACT303). When the acquired identification code does not match the identification code of the toner characteristic information B (NO in ACT303), the control unit 400 operates in another mode in which a process related to the remaining amount of toner is not performed (ACT304) and ends the process. A case where the identification codes do not match each other is a case where a set toner cartridge is a counterfeit product or the like.

When the acquired identification code matches the identification code of the toner characteristic information B (YES in ACT303), the control unit 400 copies the toner characteristic information A to the toner characteristic information B (ACT305).

The control unit 400 determines whether a request for forming an image is made in accordance with an instruction or the like from the user (ACT306). When the request for forming an image is not made (NO in ACT306), the control unit 400 determines whether the cover is opened (ACT307). When the cover is opened (YES in ACT307), the process returns to ACT301. When the cover is not opened (NO in ACT307), the process returns to ACT306.

When the request for forming an image is made (YES in ACT306), the control unit 400 acquires a toner amount indicating an amount of toner stored in the development device 14 before the image is formed (ACT308). The control unit 400 acquires a supply counter correction coefficient k from the toner characteristic information B (ACT 309).

The control unit 400 acquires/determines the counter C of the toner supply motor 31 necessary for discharging toner corresponding to a supply amount from the stored toner amount (ACT310). The control unit 400 sets a product of the counter C and the supply counter correction coefficient k as a correction counter CC (ACT311).

The control unit 400 causes the toner supply motor 31 to run by the correction counter CC (ACT312). When the image is formed (YES in ACT313), the control unit 400 updates an integrated counter of the toner characteristic information B by setting a value obtained by adding the correction counter CC to the integrated counter of the toner characteristic information B as a new integrated counter (ACT314). The control unit 400 updates the integrated counter of the toner characteristic information A by overwriting the integrated counter of the toner characteristic information B on the integrated counter of the toner characteristic information A (ACT315).

The control unit 400 performs the remaining amount display process of displaying the remaining amount of toner on the display 110 (ACT316) and returns the process to ACT306.

As illustrated in FIG. 17, since the integrated counter can be obtained in accordance with the actual discharge amount by using the supply counter correction coefficient, the image forming apparatus 100 can curb occurrence of an error.

In this way, even when one of the integration updating correction coefficient and the supply counter correction coefficient is used, the integrated counter can be obtained in accordance with the actual discharge amount. Therefore, the image forming apparatus 100 can curb occurrence of an error.

The values of the correction coefficients according to the above-described embodiments are merely exemplary. The correction coefficients are appropriately determined, for example, in accordance with characteristics of an external additive, an amount of added external additive, the shape of a toner cartridge, a supply method, and the like.

In the above-described embodiments, the external additive characteristic information included in the toner characteristic information is set as the correction coefficient, but the exemplary embodiment is not limited to this aspect. For example, the external additive characteristic information included in the toner characteristic information may be a measured value of an external additive coverage factor or a measured value of external additive adhesion intensity.

In this case, for example, the image forming apparatus 100 retains measured-value association information in which the measured value of the external additive coverage factor or the measured value of the external additive adhesion intensity is associated with the correction coefficient in advance. The measured-value association information is, for example, the information illustrated in FIGS. 9, 10, 12, and 13. The image forming apparatus 100 may convert the measured value of the external additive coverage factor or the measured value of the external additive adhesion intensity into the correction coefficient using the measured-value association information.

For example, an external server apparatus may retain the measured-value association information in advance. In this case, for example, the image forming apparatus 100 transmits a measured value of the external additive coverage factor or a measured value of the external additive adhesion intensity acquired from the storage medium 35 of the toner cartridge 30 to the server apparatus. Then, the server apparatus converts the measured value of the external additive coverage factor or the measured value of the external additive adhesion intensity into the correction coefficient using the measured-value association information. Then, the image forming apparatus 100 may acquire the correction coefficient converted by the external server apparatus.

For example, the external additive characteristic information included in the toner characteristic information may be an identifier granted based on the measured value of the external additive coverage factor or the measured value of the external additive adhesion intensity. In this case, for example, the image forming apparatus 100 retains identifier association information in which the identifier is associated with the correction coefficient in advance. Then, the image forming apparatus 100 may convert the identifier into the correction coefficient using the identifier association information.

For example, an external server apparatus may retain the identifier association information in advance. In this case, for example, the image forming apparatus 100 transmits a measured value of the external additive coverage factor or a measured value of the external additive adhesion intensity acquired from the storage medium 35 of the toner cartridge 30 to the server apparatus. Then, the server apparatus converts the measured value of the external additive coverage factor or the measured value of the external additive adhesion intensity into the correction coefficient using the identifier association information. Then, the image forming apparatus 100 may acquire the correction coefficient converted by the external server apparatus.

As described above, in the embodiment, the correction coefficient is determined in accordance with the characteristics of the external additive added to the toner with which the toner cartridge 30 is filled. In this configuration, the image forming apparatus 100 can derive the remaining amount of toner in accordance with the actual discharge amount of the toner. Thus, the image forming apparatus 100 can curb occurrence of the error and improve detection precision of the remaining amount of the toner.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

a supply unit configured to supply a recording agent including an additive to a storage unit from a recording agent cartridge; and a control unit configured to at least one of:

(i) estimate a discharged amount of the recording agent discharged from the recording agent cartridge to form an image based on (a) a running amount of the supply unit used to form the image and (b) an additive characteristic of the additive added to the recording agent; or (ii) estimate a supply amount to be discharged from the recording agent cartridge by the supply unit to form the image based on (a) the running amount of the supply unit necessary to form the image and (b) the additive characteristic of the additive added to the recording agent, and cause the supply unit to run based on the supply amount.

2. The image forming apparatus of claim 1, wherein the control unit is configured to:

acquire an indication of a stored amount of the recording agent in the recording agent cartridge; and determine a remaining amount of the recording agent in the recording agent cartridge based on (i) the stored amount and (ii) the discharged amount or the supply amount.

3. The image forming apparatus of claim 1, wherein the control unit is configured to estimate the discharged amount of the recording agent discharged from the recording agent cartridge to form the image.

4. The image forming apparatus of claim 3, wherein the additive characteristic includes a coefficient, and wherein the discharged amount is based on a product of the running amount of the supply unit and the coefficient.

5. The image forming apparatus of claim 1, wherein the control unit is configured to estimate the supply amount to be discharged from the recording agent cartridge by the supply unit to form the image.

6. The image forming apparatus of claim 5, wherein the additive characteristic includes a coefficient, and wherein the supply amount is based on a product of the running amount of the supply unit and the coefficient.

7. The image forming apparatus of claim 1, wherein the supply unit includes a motor configured to facilitate discharging the recording agent to the storage unit, and wherein the running amount of the supply unit is based on a running time of the motor.

8. The image forming apparatus of claim 1, wherein the additive characteristic is stored in a storage unit of the recording agent cartridge, and wherein the control unit acquires the additive characteristic from the storage unit.

9. The image forming apparatus of claim 1, further comprising a reader positioned to acquire the additive characteristic from the storage unit of the recording agent cartridge, wherein the control unit is coupled to the reader.

10. The image forming apparatus of claim 1, wherein the additive characteristic is based on a coverage factor of the additive with respect to the recording agent.

11. The image forming apparatus of claim 10, wherein the coverage factor of the external additive is a ratio of a projected area of the additive to a surface area of base particles of the recording agent.

12. The image forming apparatus of claim 1, wherein the additive characteristic is based on an adhesion intensity of the additive with respect to the recording agent.

13. The image forming apparatus of claim 12, wherein the adhesion intensity of the additive is based on an intensity of a fluorescent X-ray in the recording agent before a classification process and the intensity of the fluorescent X-ray in the recording agent after the classification process.

14. An image forming apparatus comprising:

a printing assembly configured to receive a toner cartridge that stores toner, the printing assembly including a motor configured to facilitate discharging the toner from the toner cartridge;

a reader positioned to read information from a storage unit of the toner cartridge, the information including a correction coefficient based on an additive in the toner and an integrated counter indicative of a stored amount of the toner in the toner cartridge; and a control unit configured to:

receive an input to print an image;

acquire the information from the toner cartridge;

operate the motor for a run time based on the input to discharge an amount of the toner to facilitate forming the image; and estimate a remaining amount of the toner stored in the toner cartridge based on the integrated counter, the correction coefficient, and the run time.

15. The image forming apparatus of claim 14, wherein the controller is configured to determine an updated integrated counter based on the integrated counter and a product of the correction coefficient and the run time, wherein the updated integrated counter is indicative of the remaining amount of the toner.

16. The image forming apparatus of claim 15, further comprising a writer configured to overwrite the integrated counter in the storage unit with the updated integrated counter, wherein the reader and the writer are separate devices or integrated into a single device.

17. An image forming apparatus comprising:

a printing assembly configured to receive a toner cartridge that stores toner, the printing assembly including a motor configured to facilitate discharging the toner from the toner cartridge;

a reader positioned to read information from a storage unit of the toner cartridge, the information including a correction coefficient based on an additive in the toner and an integrated counter indicative of a stored amount of the toner in the toner cartridge; and a control unit configured to:

receive an input to print an image;

acquire the information from the toner cartridge;

determine a run time of the motor for discharging an amount of the toner necessary for forming the image;

determine a corrected run time based on a product of the run time and the correction coefficient;

operate the motor for the corrected run time to discharge the amount of the toner necessary for forming the image; and estimate a remaining amount of the toner stored in the toner cartridge based on the integrated counter and corrected run time.

18. The image forming apparatus of claim 17, wherein the controller is configured to determine an updated integrated counter based on the integrated counter and the corrected run time, wherein the updated integrated counter is indicative of the remaining amount of the toner.

19. The image forming apparatus of claim 18, further comprising a writer configured to overwrite the integrated counter in the storage unit with the updated integrated counter.

20. A recording agent cartridge comprising:

a housing defining a reservoir configured to accommodate a recording agent including an additive; and a storage unit coupled to the housing, the storage unit configured to store additive information indicating characteristics of the additive that is usable to derive a remaining amount of the recording agent within the reservoir.

* * * * *